United States Patent [19]

Bart

[11] 4,101,076

[45] Jul. 18, 1978

[54] PIEZOELECTRIC FUEL INJECTOR VALVE

[75] Inventor: Hans U. Bart, Whitehall, Mich.

[73] Assignee: Teledyne Industries, Inc., Los Angeles, Calif.

[21] Appl. No.: 756,201

[22] Filed: Jan. 3, 1977

Related U.S. Application Data

[62] Division of Ser. No. 509,892, Apr. 3, 1975, Pat. No. 4,022,166.

[51] Int. Cl.[2] ..... B05B 1/30

[52] U.S. Cl. ..... 239/584; 251/138

[58] Field of Search ..... 123/32 JV, 32 AE; 251/138; 239/584, 585; 417/383

[56] References Cited

U.S. PATENT DOCUMENTS

| | | | |
|---|---|---|---|
| 651,381 | 6/1900 | Peters | 251/138 X |
| 2,222,141 | 11/1940 | Denison | 251/138 X |
| 3,194,162 | 7/1965 | Williams | 123/32 JV X |
| 3,391,680 | 7/1968 | Benson | 123/139 R |
| 3,501,099 | 3/1970 | Benson | 123/32 AE X |
| 3,598,506 | 8/1971 | O'Neill | 417/383 |
| 3,830,204 | 8/1974 | McAlister | 123/32 AE |
| 3,995,813 | 12/1976 | Bart et al. | 123/32 JV X |

*Primary Examiner*—Charles J. Myhre
*Assistant Examiner*—Tony M. Argenbright
*Attorney, Agent, or Firm*—Gifford, Chandler, VanOphem, Sheridan & Sprinkle

[57] ABSTRACT

An electrically operated valve in which the valve operating means is controlled in its opening movement by a piezoelectric element. The expansion or contraction of the piezoelectric element provides a lift force to the valve operating means while, preferably, a hydraulic or mechanical amplification stage is included to provide an exceedingly rapid mode of operation. The valve is particularly advantageous to control the multiple and discrete injections of fuel into an internal combustion engine.

5 Claims, 7 Drawing Figures

PIEZOELECTRIC FUEL INJECTOR VALVE

CROSS REFERENCE TO RELATED APPLICATION

This is a division of application Ser. No. 509,892 filed Apr. 3, 1975, now U.S. Pat. No. 4,022,166.

BACKGROUND OF THE INVENTION

1. Field of the Invention

This invention relates to valves, particularly those valves employed in fuel injection systems for internal combustion engines. More particularly, the valves of the invention use the change in dimensions of a piezoelectric element to effect movement of a valve needle from a closed position to an open position.

2. Description of the Prior Art

It is known that upon application of an electrical field across piezoelectric materials they expand or contract along known axes, depending on the direction in which the electrical field is applied. It is further known to stack a number of piezoelectric elements so that their cumulative expansion or contraction effect provides an increased mechanical movement. It is also known that piezoelectric elements having these expanding and contracting properties can be used to pump fuel from an injector by alternating an imposed electric field at suitable intervals. For example, Benson in U.S. Pat. No. 3,391,680 describes such a pump where the piezoelectric element is used to pressurize the fuel.

The present invention does not relate to a piezoelectric actuated pump wherein the piezoelectric element pressurizes and pumps the fuel but rather relates to a valve for precise metering and control of small quantities of an already pressurized fluid. In conventional fuel injection systems, high pressure, timed metering pump systems are used with relatively inexact timing and with nonuniform injected amounts of fuel. These are especially unsuitable for diesel engines and result in incomplete combustion which in turn increases adverse effects including both air and noise pollution.

SUMMARY OF THE INVENTION

By use of a valve constructed according to the present invention, a close control of the timing, the amount of fuel injected and the number of injections is possible. A valve body is supplied with fuel under pressure, e.g. about 6000 psi. The fuel is normally held in the valve body by a normally closed injector port which is maintained closed by a needle or other valve closure means seated in the port. A piezoelectric element cooperates with the needle in a manner such that the imposition of an electric field across the element changes its dimensions, either expanding it or contracting it, and effects movement of both the element and the needle. The latter movement opens the valve port permitting the pressurized fuel to jet therefrom.

The invention also provides a mechanical or hydraulic amplification means to magnify the stroke of the piezoelectric element to lift, for example, the needle closing the valve opening. Such a valve is exceedingly fast and capable of response within microseconds, making it particularly suitable for injection control of diesel engines. The injector valve according to the present invention thus provides a combination of control flexibility and instantaneous response.

BRIEF DESCRIPTION OF THE DRAWINGS

The following specification taken in conjunction with the appended drawings illustrates the present invention wherein.

DESCRIPTION OF THE PREFERRED EMBODIMENTS

Figure 1:
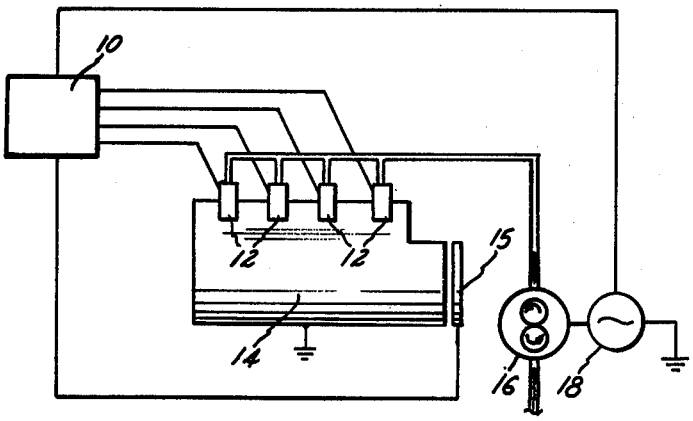
FIG. 1 is a block diagrammatic illustration of a control system for the injection of fuel into an internal combustion engine, a system in which the present invention is adapted for use.

Referring now to FIG. 1, there is shown an electrically operated fuel injection system. An electronic control circuit, identified by the numeral 10, is used to actuate the injectors 12 associated with the several cylinders of the engine 14. The control system may include various pickup devices 15 operable from the engine crankshaft or camshaft which provide timing pulses to subsequently correlate the actuation of each injector 12 with the firing of its associated cylinder at the appropriate firing angles. The fuel is provided under pressure from a pump 16 to the individual cylinder injectors 12, while a source of electricity 18 is used to drive the pump 16 and to provide the required operating voltage for the electrical control system 10.

Figure 2:
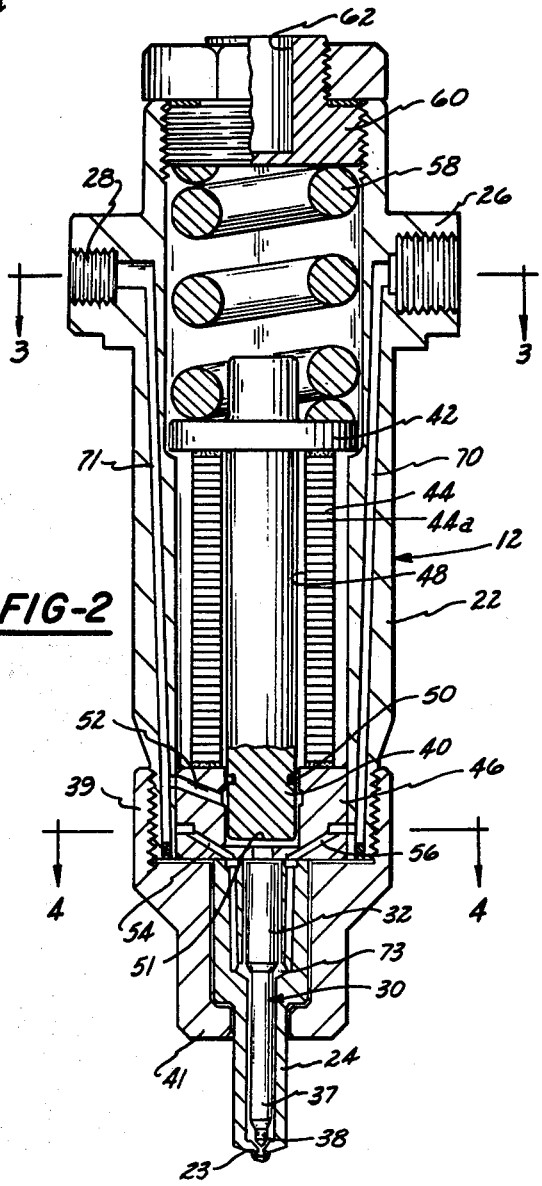
FIG. 2 is a longitudinal sectional view of an injector valve suitable for use in the control system of FIG. 1.

FIG. 2 shows the basic parts of the injector valve 12, which include a valve body 22, a valve nozzle 24, a fuel inlet connector 26 (attached to a source of pressurized fuel, not shown) and a fuel leak off connector 28.

The operating means for the valve includes at its lower end a needle 30 extending into the opening 23 of the nozzle 24. The needle 30 includes an upper enlarged plunger 32, a reduced diameter stem portion 37 and a lower conical flared tip 38 which seats in the opening 23. The nozzle 24 is secured in place at the lower end of the valve body 22 by a threaded retainer cap 41.

The upper end of the valve operating means includes a piston 40 having a cap 42 connected to its upper end. A stack 44 of piezoelectric discs 45 is shown mounted between the lower surface of the cap 42 and an upper surface of a valve end-plug 46. It will further be seen that the piezoelectric disc stack 44 includes a central passageway 48 in which the piston 40 is movable upwardly and downwardly. An o-ring 50 is employed to provide a proper seal about the piston 40. Intermediate the lower end of the piston 40 and plunger 32 there is provided a chamber 51 wherein hydraulic amplification takes place in a manner to be described hereinafter. Also shown at the lower portion of the plug 46 are conduits 52, 54, and 56. Conduits 54 and 56 are connected to an inlet fuel line conduit 70. Conduit 52, in fluid communication with a fuel leak off line 71, relieves O-ring 50 from high pressure. The conduits 54 and 56 are both in fluid communication with the inner channel 73 of the nozzle 24. Fluid conduits 70, 54, 56 and 73; serve as pressurized liquid storage chambers.

Also included in the valve body 22 at its upper end is a means for biasing the cap 42, the piston 40, and the stack 44 downwardly in the normally closed position of the valve. This biasing means includes a coil spring 58 and an adjusting nut 60 having a slot 62 to permit its ready adjustment. It is the main function of the spring 58 to absorb the energy of the stroke of the piston 40 when it is moved upwardly by expansions of the stack 44.

Figure 3:
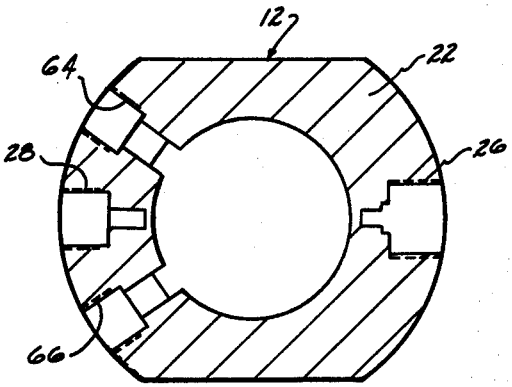
FIG. 3 is a cross-sectional view of the valve of FIG. 2 taken along the section lines 3—3.

FIG. 3 is a sectional view of the injector of FIG. 2 showing the fuel inlet 26, the fuel leak off connector 28 and a pair of electrical connector inlets 64 and 66; the latter being adapted to hold electrical leads which in turn are connected to a suitable source of electrical potential to provide the required electrical field across the discs 45 of the stack 44, whereby the stack expansion is provided axially with respect to the piston 40.

Figure 4:
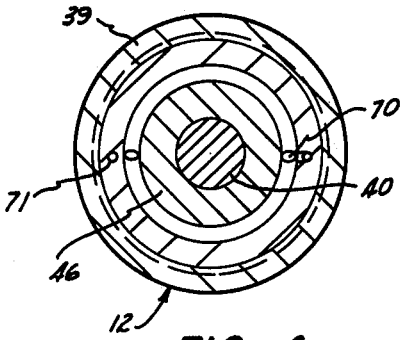
FIG. 4 is a cross-sectional view of the valve of FIG. 2 taken along section lines 4—4.

FIG. 4 shows the lower section taken across the injector of FIG. 2. Included are the piston 40, the end-plug 46, and the upper end 39 of the nozzle retainer 41. Also shown are the two vertical conduits 70 and 71 for inlet fuel and for leak off fuel, respectively.

Figure 5:
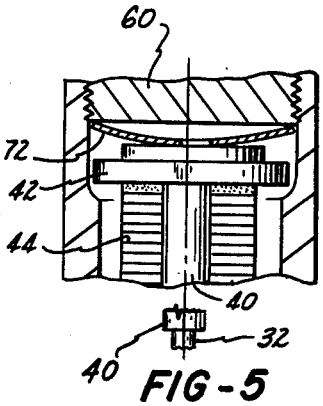
FIG. 5 is a partial sectional view of a valve incorporating an alternative construction of the spring biasing and valve operating means.

FIG. 5 shows the stack 44 and the cap 42 of the valve operating piston 40. A spring biasing means, different from that shown in FIG. 2, is connected between the closed end plug 60 of the valve and the upper surface of the cap 42. The alternate biasing means is shown as a resilient washer type-spring 72, which, for example, may be of a spring steel. It is possible to adjust the downward force exerted by the resilient washer 72 by turning the threaded plug 60 upwardly or downwardly in a manner already discussed in connection with FIG. 2. Also shown in FIG. 5 is the lower end of the piston 40 which is directly connected to the plunger 32 of the needle 30.

In the alternate embodiment illustrated in FIG. 5, the piston 40 and the needle 30 form a single unit structure and the stack 44 thus moves upwardly to lift the needle 30 to open the opening 23. Otherwise stated, the intermediate pressurized fluid chamber 51 (as shown in FIG. 2) is omitted from the structure of the injector shown in FIG. 5. The spring 72 thus serves to depress the end 38 of needle 30 directly into normal closing contact with the opening 23 in valve nozzle 24.

Figure 6:
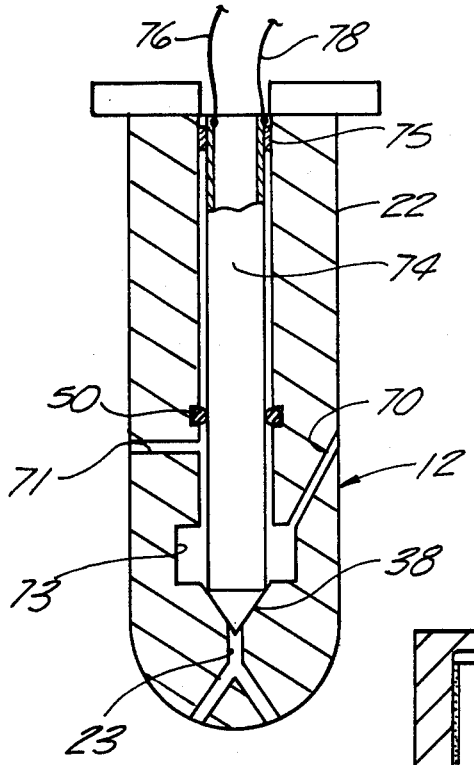
FIG. 6 is a diagrammatic cross-sectional view of an alternative embodiment of the invention wherein the piezoelectric element is in the form of a tube.

FIG. 6 shows diagrammatically the use of a piezoelectric element in the form of a tube 74. The tube 74 is secured to the valve body 22 by a collar 75, for example; and is coated on its inner surface and outer surface with a conductive coating (not shown), such as a copper coating. An electrical wire 76 from a source of electrical potential is connected to the inner conducting layer and a corresponding electrical wire 78 is connected to the outer conducting layer of the tube 74. Fuel inlet conduit 70 is connected to a suitable source of pressurized fuel (not shown).

The application of a direct current potential across the wall of piezoelectric tube 74 causes the latter to contract longitudinally thus lifting tip 38 away from opening 23. The latter movement causes fuel under pressure within the valve body, such as fuel in chamber 73, to jet outwardly from the injector. When the electric potential across the tube 74 is removed the tube expands longitudinally and urges the tip 38 to seat in the injector opening 23.

Figure 7:
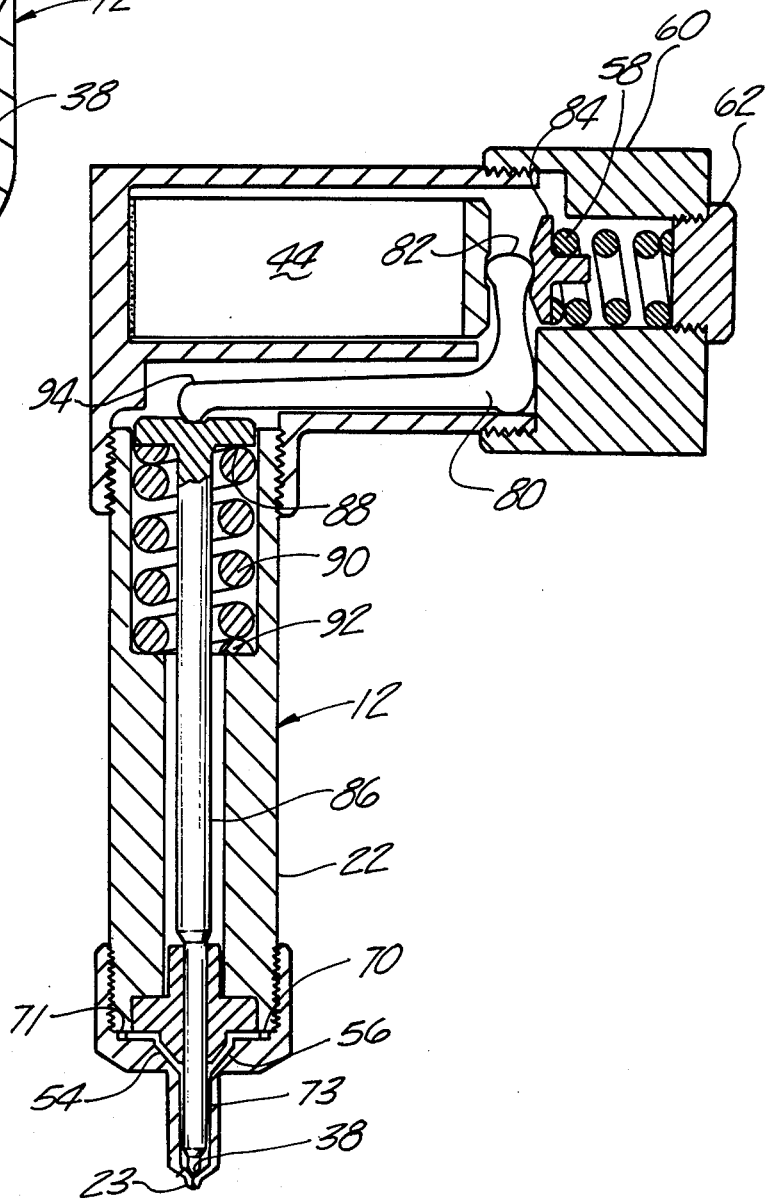
FIG. 7 is a cross-sectional view of still another embodiment of the invention showing the amplification of the piezoelectric element stroke by mechanical means.

FIG. 7 shows an embodiment of the invention wherein the stroke of the piezoelectric element 44 is magnified mechanically by a lever 80. A electroexpansive piezoelectric stack 44 similar to that shown in FIG. 2 presses against the short arm 82 of the lever 80; which, in turn, presses against spring retaining button 84. A spring 58, retained between the button 84 and adjusting nut 62, biases the lever arm 82 against the stack 44.

The valve needle 86 of the injector of FIG. 7 extends from the tip 38 to the spring retaining flange 88. The spring 90 is retained between the flange 88 and the shoulder 92 and biases the needle 86 upwardly while the long arm 94 of lever 80 presses the flange 88 and the needle 86 downwardly. Spring 58 and spring 90 are selected such that the injector opening is normally closed but such that relaxation of spring 58 by movement of stack 44 to the right (as shown) causes lever arm 82 to rotate to the right, lever arm 94 to move upwardly, and needle 86 to move upwardly to open the injector 12. The latter movement causes pressurized fuel within the valve body, such as fuel in chamber 73, to jet from the opening 23. When the electrical potential across the stack 44 is removed the latter contracts, spring 58 continues to press the lever arm 82 which moves to the left, lever arm 94 moves downwardly to press flange 88 and spring 90 downwardly, and needle 86 and tip 38 move downwardly to close opening 23.

All embodiments of the invention utilize a change in dimension of the piezoelectric stack 44, either expansion or contraction, to open the injection valve 12. In the injector shown in FIG. 5 expansion of the stack 44 effects directly the lifting of the needle 30. In the injector shown in FIG. 6 longitudinal contraction of the tube 74 effects directly the lifting of the needle 30. The embodiments of FIG. 2 and FIG. 7 includes means for hydraulic and mechanical amplification, respectively, of the stroke of the piezoelectric element.

In the operation of the injector of FIG. 2, a direct current voltage is imposed longitudinally on the stack 44 in a manner to effect the expansion thereof. Thus causes the shoulder 42 and the piston 40 to move vertically upwardly (as shown). Upward movement of the piston 44 relieves the pressure within the chamber 51, thus creating a differential hydraulic pressure, or force, on the needle 30 and causing the needle to rise. A lifting of the needle 30 opens opening 23 whereupon the pressurized fuel within the valve body jets outwardly. Because the cross sectional area of the bottom of piston 40 is greater than the effective cross sectional area of the needle the length of the stroke of the needle will be greater than the length of the stroke of the piezoelectric element and the stroke of the piston.

Similarly, in the structure of FIG. 7, and because lever arm 94 is longer than lever arm 82 the stroke of the needle 86 is greater than the stroke of the piezoelectric element 44.

The major advantages of the invention are derived from the fact that the piezoelectric element responds rapidly to the imposed electric potential; for example, lifting a steel needle through a distance of about 0.006–0.01 inches in about 30–150 microseconds.

Because of the rapid response of the needle, actual tests showed that the duration of injections could be controlled within thirty microseconds without ragged spray initiation or termination dribble, making possible carefully controlled multiple and discrete injections into an engine cylinder as the piston approaches top dead center. The latter characteristic has shown to be of particular advantage in diesel engines where the released heat and pressure rise in the cylinder can be controlled by the rate and number of injections to effect more complete combustion of the fuel at lower peak temperatures and pressure.

It will thus be seen that I have provided a novel and improved piezoelectric operated valve of a type which is of particular utility for internal combustion engine injection systems.

I claim:

1. A liquid fuel injector valve for an internal combustion engine said valve comprising:

a. a valve body adapted to contain liquid fuel therein under pressure, said valve body having a liquid fuel inlet port and a liquid fuel outlet port;

b. closure means movable between a first position where said closure means closes said outlet port to a second position where said outlet port is open;

c. a piezoelectric element cooperative with said closure means for effecting the movement of said closure means from said first position to said second position in response to an electrical potential imposed across said element;

d. biasing means for maintaining said closure means in said first position in the absence of said imposed potential;

e. a lever having a relatively short arm, a relatively long arm and a pivot point therebetween, means for biasing said short arm against said element so that said short arm follows the movements of said element, wherein said long arm is mechanically coupled to said closure means whereby said lever magnifies the stroke of said closure means relative to the stroke of said element; and wherein the opening of said outlet port causes liquid fuel contained within said valve body under pressure to jet from said outlet port.

2. The valve as defined in claim 1 wherein said closure means is a valve needle which, in said first position, seats in said outlet port.

3. The valve as defined in claim 1 wherein said element is in the form of a stack of coaxial discs.

4. The valve as defined in claim 1 wherein said biasing means is a spring.

5. A liquid fuel injector valve for an internal combustion engine said valve comprising:

a. a valve body adapted to contain liquid fuel therein under pressure, said valve body having a liquid fuel inlet port and a liquid fuel outlet port;

b. closure means movable between a first position where said closure means closes said outlet port to a second position where said outlet port is open;

c. a piezoelectric element cooperative with said closure means for effecting the movement of said closure means from said first position to said second position in response to an electrical potential imposed across said element;

d. biasing means for maintaining said closure means in said first position in the absence of said imposed potential; and wherein the opening of said outlet port causes liquid fuel contained within said valve body under pressure to jet from said outlet port;

a lever having a relatively short arm, a relatively long arm a pivot point therebetween and a second spring adapted to bias said short arm against said element in a manner such that said short arm follows the movements of said element; and wherein said closure means is a valve needle which seats in said outlet port and moves cooperatively with said long arm, said biasing means is a spring, wherein said short arm moves cooperatively with said element, and wherein movement of said lever effects a magnification of the stroke of said needle relative to the stroke of said element.

* * * * *